US008396399B2

(12) United States Patent
Yamashita et al.

(10) Patent No.: US 8,396,399 B2
(45) Date of Patent: Mar. 12, 2013

(54) TONER BEARING MEMBER, DEVELOPING DEVICE, IMAGE FORMING APPARATUS, AND IMAGE FORMING METHOD

(75) Inventors: Yasuyuki Yamashita, Zama (JP); Keiko Osaka, Mishima (JP); Ryoichi Kitajima, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 353 days.

(21) Appl. No.: 12/791,544

(22) Filed: Jun. 1, 2010

(65) Prior Publication Data

US 2010/0303509 A1 Dec. 2, 2010

(30) Foreign Application Priority Data

Jun. 2, 2009 (JP) ..... 2009-132832

(51) Int. Cl.
*G03G 15/08* (2006.01)

(52) U.S. Cl. ..... 399/266; 399/239; 399/279; 399/313

(58) Field of Classification Search ..... 399/239, 399/279, 313, 266, 333, 133, 147, 159
See application file for complete search history.

(56) References Cited

U.S. PATENT DOCUMENTS

| | | | | |
|---|---|---|---|---|
| 6,901,232 | B2 * | 5/2005 | Sakuma et al. | 399/266 |
| 2008/0063963 | A1 * | 3/2008 | Tajima et al. | 430/69 |
| 2009/0041492 | A1 * | 2/2009 | Horike et al. | 399/55 |

FOREIGN PATENT DOCUMENTS

| | | |
|---|---|---|
| JP | 3-21967 | 1/1991 |
| JP | 2007-133388 | 5/2007 |
| JP | 2007-310355 | 11/2007 |

* cited by examiner

*Primary Examiner* — Walter L Lindsay, Jr.
*Assistant Examiner* — Roy Y Yi
(74) *Attorney, Agent, or Firm* — Cooper & Dunham LLP

(57) ABSTRACT

A toner bearing member is provided which includes a conductive support, an insulation layer provided on the conductive support, multiple electrodes arranged at regular intervals on the insulation layer, a surface layer covering the multiple electrodes, comprising a polymerized compound having a specific unit, and a voltage applicator that applies a voltage between the conductive support and the multiple electrodes while periodically reversing an electric field generated therebetween.

6 Claims, 3 Drawing Sheets

TONER BEARING MEMBER, DEVELOPING DEVICE, IMAGE FORMING APPARATUS, AND IMAGE FORMING METHOD

CROSS-REFERENCE TO RELATED APPLICATIONS

The present patent application claims priority pursuant to 35 U.S.C. §119 from Japanese Patent Application No. 2009-132832, filed on Jun. 2, 2009, which is hereby incorporated by reference herein in its entirety.

BACKGROUND

1. Field of the Invention

The present invention relates to a toner bearing member, a developing device including the toner bearing member, an image forming apparatus including the toner bearing member, such as copiers, printers, and facsimile machines, and an image forming method using the toner bearing member.

2. Description of the Background

In an electrophotographic image forming apparatus such as a copier or a printer, an electrostatic latent image formed on an electrostatic latent image bearing member (e.g., a photoreceptor) is developed into a toner image by a toner bearing member, which may or may not contact the electrostatic latent image bearing member directly. The latter development process, often referred to as contactless, includes a number of different individual processes, such as a powder cloud process, a toner projection process, and an electric field curtain process, for example.

In the toner projection process, toner particles on a toner bearing member are forced, or projected, onto the electrostatic latent image bearing member and adhere to an electrostatic latent image formed thereon by applying a voltage stronger than the adhesive force between the toner particles and the toner bearing member.

In the electric field curtain process, the toner bearing member internally contains a plurality of electrodes arranged at regular intervals. By applying an alternating electric field to the electrodes, an alternating non-uniform electric field is generated on a surface of the toner bearing member and forms an electric field curtain. Previously charged toner particles on the toner bearing member are forced by the electric field and projected from the surface thereof. Since the electric field is periodically reversed, the toner particles also periodically change their direction of movement oppositely along the circumferential surface of the toner bearing member. Such a movement of the toner particles on the circumferential surface of the toner bearing member is hereinafter referred to as "hopping". When the frequency of the alternating electric field is relatively high, the toner particles are likely to consistently suspend near the surface of the toner bearing member, thus forming toner clouds. The toner clouds then adhere to an electrostatic latent image formed on the electrostatic latent image bearing member. While the toner particles are hopping, the adhesive force between the toner particles and the toner bearing member is substantially zero, which means that no force is needed to separate the toner particles from the toner bearing member. In other words, the toner particles can be satisfactorily supplied to the photoreceptor with a low voltage.

Japanese Patent Application Publication No. H03-21967-A discloses a developing device employing an electric field curtain process. The developing device includes a toner bearing member including multiple electrodes, which are covered with an insulating surface protective layer. Owing to the insulating surface protective layer, the charge of toner particles on the toner bearing member is prevented from leaking into the electrodes. Thus, the toner particles are able to satisfactorily hop on the toner bearing member, resulting in formation of toner clouds. However, it requires an extra process for frictionally charging the toner particles in advance because the toner particles are never frictionally charged with the toner bearing member.

By contrast, Japanese Patent Application Publication Nos. 2007-310355-A and 2007-133388-A each disclose a developing device employing an electric field curtain process, in which the surface of the toner bearing member comprises a material capable of frictionally charging toner particles to a proper polarity. Thus, the toner particles can be charged while hopping on the toner bearing member without an extra process for frictionally charging the toner particles in advance.

However, if the toner particles are excessively charged by contact with the surface of the toner bearing member, a strong electrostatic adhesive force may be generated between the toner particles and the surface of the toner bearing member. When the electrostatic adhesive force is stronger than the force causing hopping of the toner particles, the toner particles may stick to the surface of the toner bearing member without hopping, in other words, without forming toner clouds. Consequently, the toner particles may not be charged to a proper polarity, resulting in production of abnormal images.

Moreover, even if toner clouds are formed normally and normal images are produced in the initial stage, the resulting image quality is likely to deteriorate with time. This is because the adhesive force between the toner bearing member and toner particles varies with gradual abrasion of the surface of the toner bearing member, which causes variation in the electric field of the electrodes in the toner bearing member, the surface roughness of the toner bearing member, the toner charge, etc.

Accordingly, a need exists for charging toner particles to the proper polarity while allowing the toner particles to hop on the toner bearing member to satisfactorily form toner clouds for an extended period of time.

SUMMARY

Exemplary aspects of the present invention are put forward in view of the above-described circumstances, and provide a novel toner bearing member, a novel developing device, and a novel image forming apparatus.

In one exemplary embodiment, a novel toner bearing member includes a conductive support, an insulation layer provided on the conductive support, multiple electrodes arranged at regular intervals on the insulation layer, a surface layer covering the multiple electrodes, including a polymerized compound having a unit represented by the following formula (1), and a voltage applicator that applies a voltage between the conductive support and the multiple electrodes while periodically reversing an electric field generated therebetween:

(1)

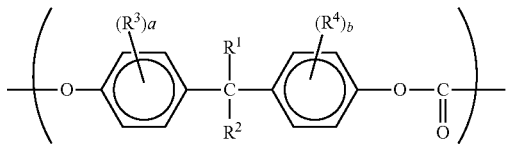

wherein each of $R^1$ and $R^2$ independently represents a hydrogen atom, an alkyl group, an aryl group, or $R^1$ and $R^2$ may share ring connectivity to form a cyclic hydrocarbon group having 5 to 8 carbon atoms; each of $R^3$ and $R^4$ independently represents a hydrogen atom, a halogen atom, an alkyl group, or an aryl group; and each of a and b independently represents an integer of 1 or 2.

In another exemplary embodiment, a novel developing device includes the above toner bearing member.

In yet another exemplary embodiment, a novel image forming apparatus includes an electrostatic latent image bearing member for bearing an electrostatic latent image and the above toner bearing member for supplying toner particles to the electrostatic latent image.

In further exemplary embodiment, a novel image forming method includes applying an electrical field to the above toner bearing member bearing toner particles, disposed in proximity to an image bearing member bearing an electrostatic latent image; periodically reversing the electric field applied to the toner bearing member to cause the toner particles to move circumferentially along the rotating surface of the toner bearing member; and supplying the moving toner particles from the toner bearing member to the electrostatic latent image on the image bearing member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
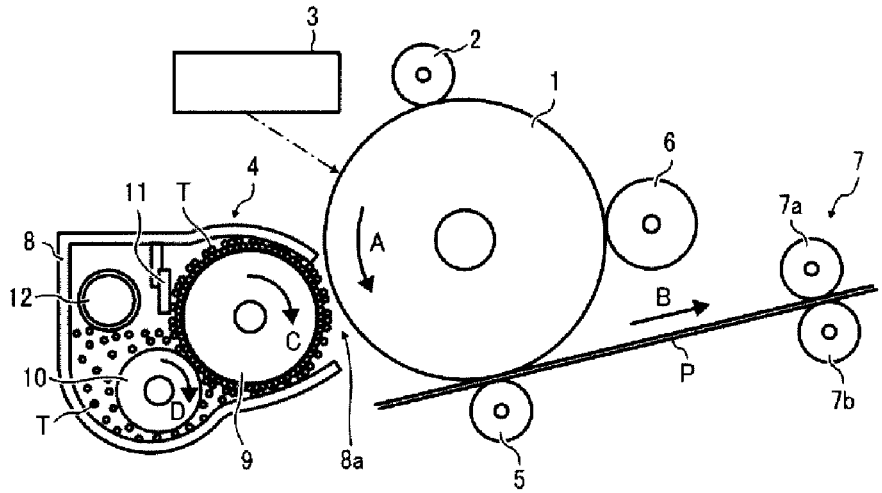
FIG. 1 is a schematic view illustrating an image forming apparatus according to this patent specification.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 is a schematic view illustrating an image forming apparatus according to this patent specification. The image forming apparatus includes a drum-shaped photoreceptor 1 (i.e., an image bearing member) that rotates in a direction indicated by arrow A in FIG. 1; a charging roller 2 that uniformly charges a surface of the photoreceptor 1; a light emitting device 3 that emits a laser light beam containing image information to a surface of the photoreceptor 1; a developing device 4 that supplies toner particles to an electrostatic latent image formed on the surface of the photoreceptor 1 to form a toner image; a transfer roller 5 that transfers the toner image from the photoreceptor 1 onto a transfer material P; a cleaning device 6 that removes residual toner particles remaining on the surface of the photoreceptor without being transferred on the transfer material P; and a fixing device 7 that fixes the toner image transferred onto the transfer material P by application of heat and pressure.

A process of forming a toner image on a transfer material P in this image forming apparatus is described below. A surface of the photoreceptor 1 rotating in a direction indicated by arrow A in FIG. 1 is uniformly charged by the charging roller 2 by applying a predetermined voltage thereto. The uniformly charged surface of the photoreceptor 1 is exposed to a laser light beam containing image information emitted from the light emitting device 3 to form an electrostatic latent image thereon. Toner particles supplied from the developing device 4 electrostatically adhere to the electrostatic latent image to form a toner image. The toner image thus formed is transferred from the photoreceptor 1 onto the transfer material P by pressing the transfer roller 5 against the photoreceptor 1 with the transfer material P therebetween and conveying the transfer material P in a direction indicated by arrow B while applying a bias voltage to the transfer roller 5. The toner image is fixed on the transfer material P in the fixing device 7 by application of heat and pressure from a heat roller 7*a* and a pressure roller 7*b*, respectively. The cleaning device 6 removes residual toner particles remaining on the surface of the photoreceptor 1 without being transferred onto the transfer material P. The cleaned surface of the photoreceptor 1 is uniformly charged by the charging roller 2 again. The above-described series of operations is repeated.

The developing device 4 includes a toner container 8 that contains toner particles T, within which a toner bearing member 9 and a circulation paddle 10 are rotatably provided. The toner bearing member 9 is driven to rotate in a direction indicated by arrow C by a driving mechanism, not shown, so as to supply toner particles to the photoreceptor 1 through an opening 8*a*. The circulation paddle 10 rotates in a direction indicated by arrow D so as to circulate and charge toner particles T and further supply the toner particles T to a surface of the toner bearing member 9. The surface of the toner bearing member 9 electrostatically attracts the toner particles, while a toner controlling blade 11 controls the amount of the toner particles held on the toner bearing member 9. The toner controlling blade 11 is provided within the toner container 8 with forming a predetermined gap between the toner bearing member 9. An alternating electric field is applied to the toner bearing member 9 so that clouds of the toner particles T are formed at the opening 8*a*. The toner particles T in the clouds electrostatically adhere to an electrostatic latent image on the photoreceptor 1, resulting in formation of a toner image. In FIG. 1, a numeral 12 denotes a toner supply opening that supplies supplemental toner particles.

Figure 2:
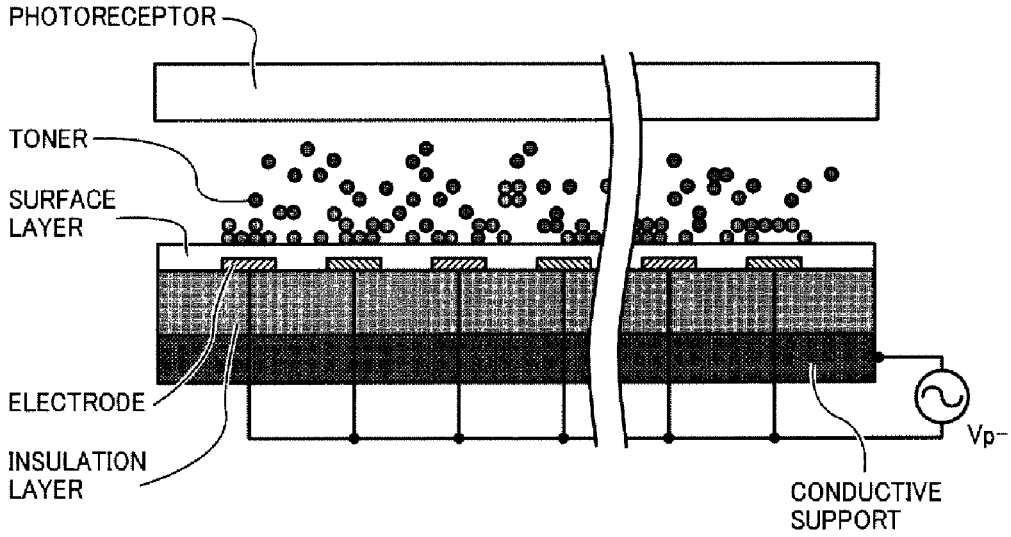
FIG. 2 is a schematic view illustrating a surface of the toner bearing member of the image forming apparatus illustrated in FIG. 1.

FIG. 2 is a schematic view illustrating a surface of the toner bearing member 9. As shown in FIG. 2, the surface of the toner bearing member 9 has a multilayer structure including, from an inner side thereof, a conductive support, an insulation layer, an electrode pattern, and a surface layer.

Figure 3B:
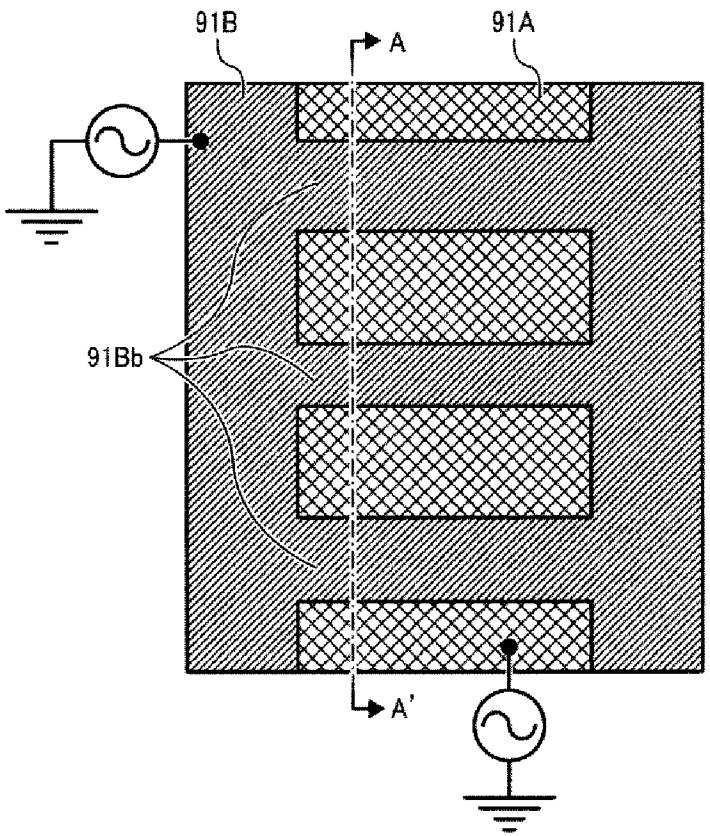
FIGS. 3A and 3B are cross-sectional and overhead views, respectively, illustrating an embodiment of a surface of the toner bearing member illustrated in FIG. 2.
Figure 3A:
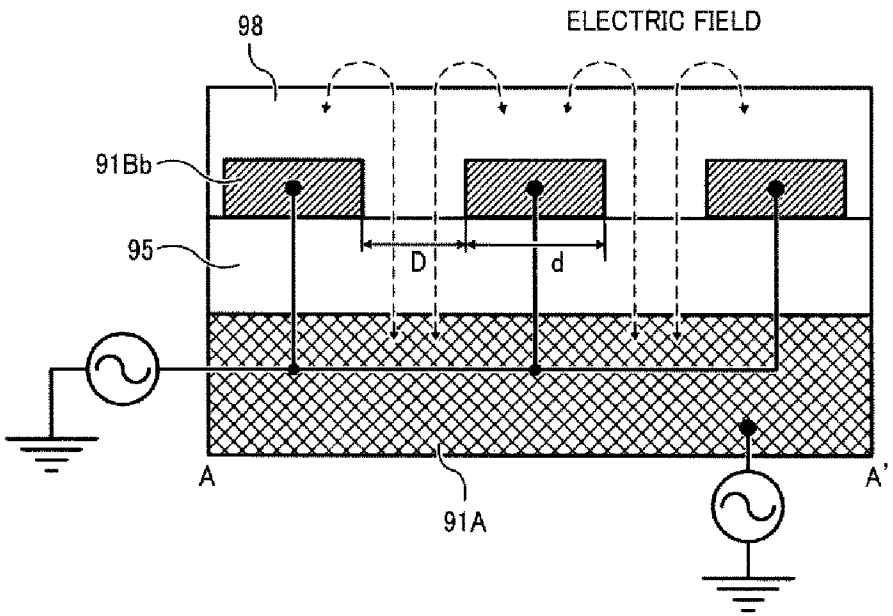

FIGS. 3A and 3B are cross-sectional and overhead views, respectively, illustrating an embodiment of a surface of the toner bearing member 9. FIG. 3A is a cross-section passing through a line A-A' in FIG. 3B. The toner bearing member 9 includes a first electrode that is a conductive support 91A and a second electrode that is an electrode pattern 91B comprising multiple linear electrodes 91Bb formed on an insulation layer 95. The electric potential difference between the conductive support 91A and the electrodes 91Bb causes toner hopping, resulting in formation of toner clouds.

An electrode pattern 91B can be formed by, for example, a photoresist technique in which a thin copper film deposited on a peripheral surface of the cylindrical support 91A is processed to have a desired pattern. Alternatively, the electrode pattern 91B can be drawn using an inkjet apparatus.

Suitable materials for the conductive support 91A include highly conductive materials such as aluminum and aluminum alloy, but are not limited thereto. The size of the conductive support 91A is not limited to a particular size. Also, the width d of each electrode 91Bb and the interval D between adjacent electrodes 91Bb are not limited to a particular length.

However, the resulting toner clouds condition depends on the width d of each electrode 91Bb, the interval D between adjacent electrodes 91Bb, and the alternating electric voltage applied. To form toner clouds in good condition, the width d of each electrode 91Bb is preferably from 40 to 250 μm and the interval D between adjacent electrodes 91Bb is preferably from 05 to 500 μm. The alternating electric voltage preferably has a frequency of from 100 Hz to 5 KHz and a voltage of from 100 V to 3 KV.

Suitable materials for the electrodes 91Bb include highly conductive materials. Paste-like materials are also suitable for drawing the electrode pattern.

The alternating voltage applied to the toner bearing member 9 may be either single-phase or plural-phase having different cycles. Such an alternating voltage periodically changes the direction of the electric field between the electrodes, thereby causing toner particles T to hop between a surface of the photoreceptor 1 and a surface layer 98 of the toner bearing member 9, in other words, forming toner clouds therebetween. The toner particles T in the toner clouds are electrostatically attracted to an electrostatic latent image formed on a surface of the photoreceptor 1. Thus, a toner image is formed.

Suitable materials for the conductive support include, but are not limited to, metals (e.g., Al, Ni, Fe, Cu, Au) and alloys thereof; insulative substrates (e.g., polyester, polycarbonate, polyimide, glass) on which a thin layer of a metal (e.g., Al, Ag, Au) or a conductive material (e.g., $In_2O_3$, $SnO_2$) is formed; conductive resin substrates in which powders of a carbon black, a graphite, a metal (e.g., aluminum, copper, nickel), or a conducive glass are uniformly dispersed in a resin; and cylindrical paper substrates treated to have conductivity.

Suitable materials for the insulation layer include, but are not limited to, synthetic resins such as polyester, polyimide, nylon, fluorocarbon resins, polyacetal, phenol, and polystyrene.

Preferably, materials composing the insulation layer are different from those composing the surface layer. This is because, in a case where the surface layer is formed on the insulation layer by dip coating or spray coating, the insulation layer is affected by solvents included in the surface layer coating liquid. As a result, the distance between the insulation layer and the surface layer may be changed to weaken the electric field strength, or the electrodes may be buried in the insulation layer and contacted the conductive support to short-circuit, thereby suppressing toner hopping. In particular, when the insulation layer is comprised of a material having no cross-linked structure, such as polycarbonate, there is a great possibility to be affected by the surface layer coating liquid.

Specific examples of suitable materials for the insulation layer include, but are not limited to, water-soluble resins (e.g., polyvinyl alcohol, casein, sodium polyacrylate), alcohol-soluble resins (e.g., copolymerized nylon, methoxymethylated nylon), and curable resins which form a three-dimensional network structure (e.g., polyurethane resins, melamine resins, alkyd-melamine resins, epoxy resins), all of which have poor solubility in organic solvents. Among these materials, alkyd-melamine resins are most preferable.

The insulation layer is formed by a coating method using an arbitrary solvent, for example.

The insulation layer preferably has a thickness of from 1 to 100 μm, and more preferably from 1 to 50 μm. When the insulation layer is too thin, it may be difficult to prevent charge leakage between the electrodes and toner particles. When the insulation layer is too thick, it may be difficult to generate an electrostatic force which causes toner hopping because the electric field from the inner electrodes may be weakened.

Unlike most related-art toner bearing members including an amino-group-containing material in their surface layers for negatively charging toner particles, the surface layer of the toner bearing member according to this specification comprises a polymerized compound having a unit represented by the following formula (1):

(1)

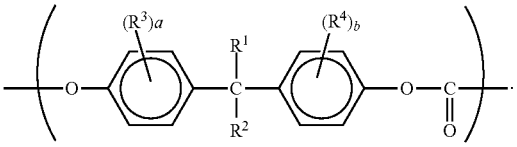

Each of $R^1$ and $R^2$ independently represents a hydrogen atom, an alkyl group which may have a substituent, an aryl group which may have a substituent, or $R^1$ and $R^2$ may share ring connectivity to form a cyclic hydrocarbon group having 5 to 8 carbon atoms. Each of $R^3$ and $R^4$ independently represents a hydrogen atom, a halogen atom, an alkyl group which may have a substituent, or an aryl group which may have a substituent. "a" and "b" represent the number of $R^3$ and $R^4$, respectively, binding to respective benzene ring, each of which independently being an integer of 1 or 2. When a=2, the multiple $R^3$ may be, but need not necessarily be, the same. When b=2, the multiple $R^4$ may be, but need not necessarily be, the same.

Such a surface layer is capable of both reliably forming toner clouds for an extended period of time and improving abrasion resistance of the toner bearing member.

The surface layer may be comprised of either a single layer or multiple layers.

Specific examples of the unit (1) include the following units (M-1) to (M-19), but are not limited thereto.

(M-1)

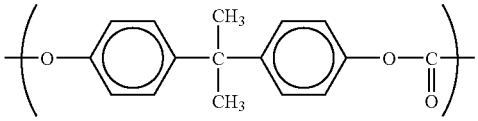

(M-2)

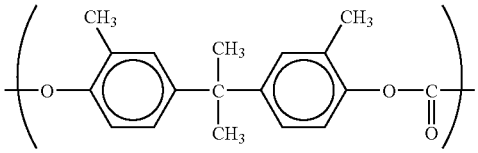

-continued
(M-3)
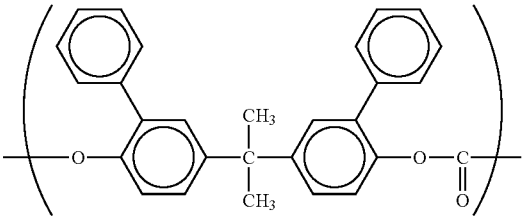
(M-4)
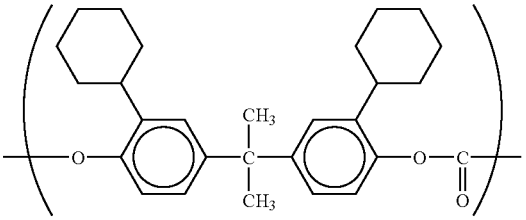
(M-5)
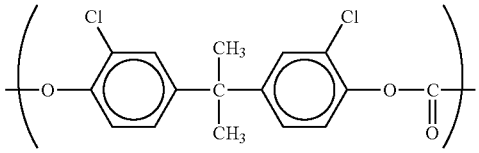
(M-6)
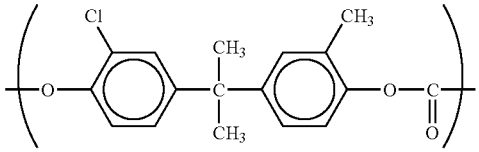
(M-7)
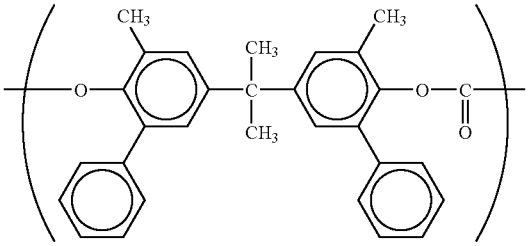
(M-8)
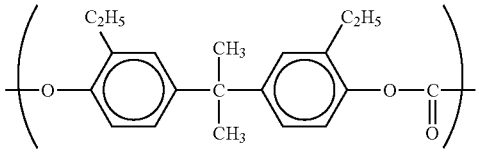
(M-9)
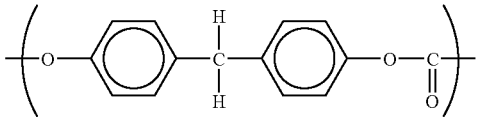
(M-10)
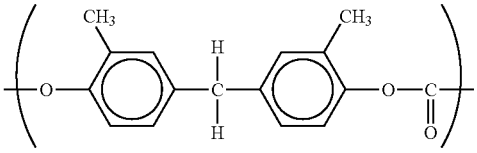
-continued
(M-11)
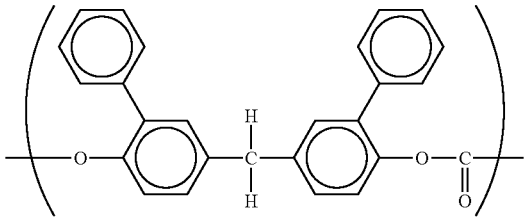
(M-12)
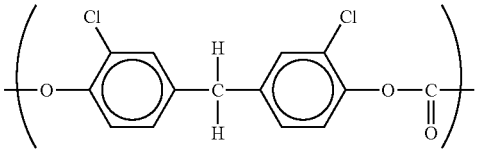
(M-13)
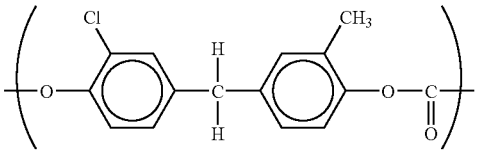
(M-14)
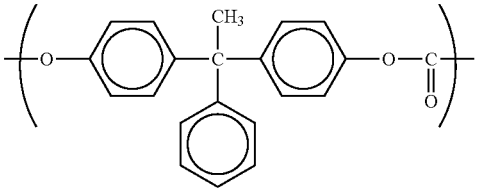
(M-15)
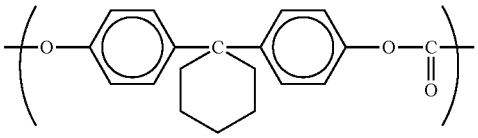
(M-16)
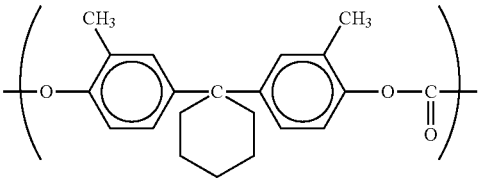
(M-17)
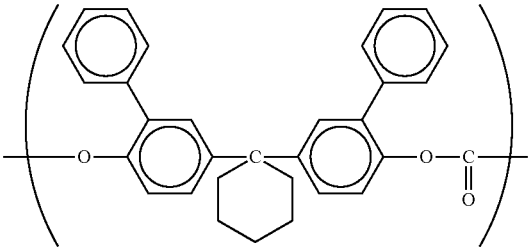

-continued (M-18)

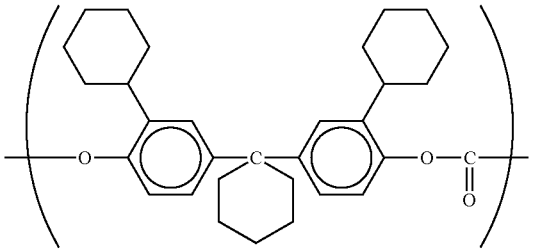

(M-19)

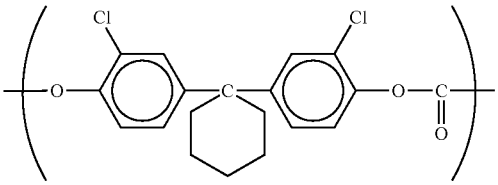

From the viewpoint of ease in handling, the polymerized compound preferably has a molecular weight of from 30,000 to 60,000.

The surface layer may include a leveling agent. Silicone-oil-based leveling agents are preferable because they are capable of giving high smoothness with a small amount. Specific examples of such silicone-oil based leveling agents include, but are not limited to, dimethyl silicone oil, methylphenyl silicone oil, methyl hydrogen polysiloxane, cyclic dimethyl polysiloxane, alkyl-modified silicone oil, polyether-modified silicone oil, alcohol-modified silicone oil, fluorine-modified silicone oil, amino-modified silicone oil, mercapto-modified silicone oil, epoxy-modified silicone oil, carboxyl-modified silicone oil, higher fatty acid-modified silicone oil, and higher fatty acid-containing silicone oil.

Further, the surface layer may include any additives such as a plasticizer and an antioxidant.

The surface layer can be formed by typical coating methods such as dip coating and spray coating. A surface layer coating liquid includes at least one solvent which dissolves the polymerized compound, such as tetrahydrofuran.

The surface layer preferably has a thickness of from 0.5 to 50 μm. When the surface layer is too thin, it may be difficult to prevent charge leakage between the electrodes and toner particles. When the surface layer is too thick, it may be difficult to generate an electrostatic force which causes toner hopping because the electric field from the inner electrodes may be weakened. More preferably, the surface layer has a thickness of from 5 to 50 μm to cause more reliable toner hopping.

As described above, exemplary aspects of the present specification provide the toner bearing member illustrated in FIGS. 3A and 3B which reliably forms toner clouds for an extended period of time. Exemplary aspects of the present specification also provide a toner bearing member illustrated in FIGS. 4A and 4A.

Figure 4B:
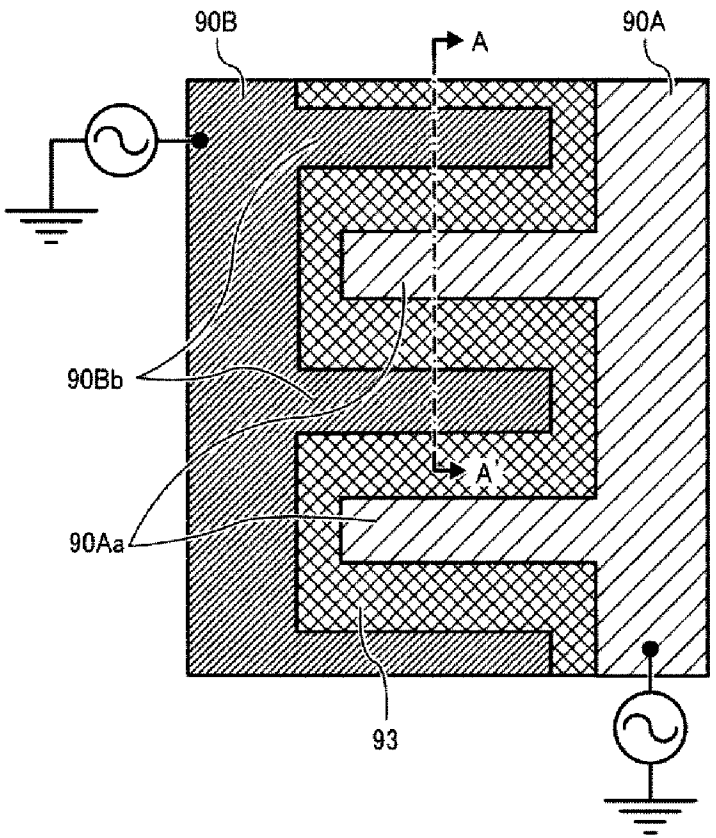
FIGS. 4A and 4B are cross-sectional and overhead views, respectively, illustrating another embodiment of a surface of the toner bearing member illustrated in FIG. 2.
Figure 4A:
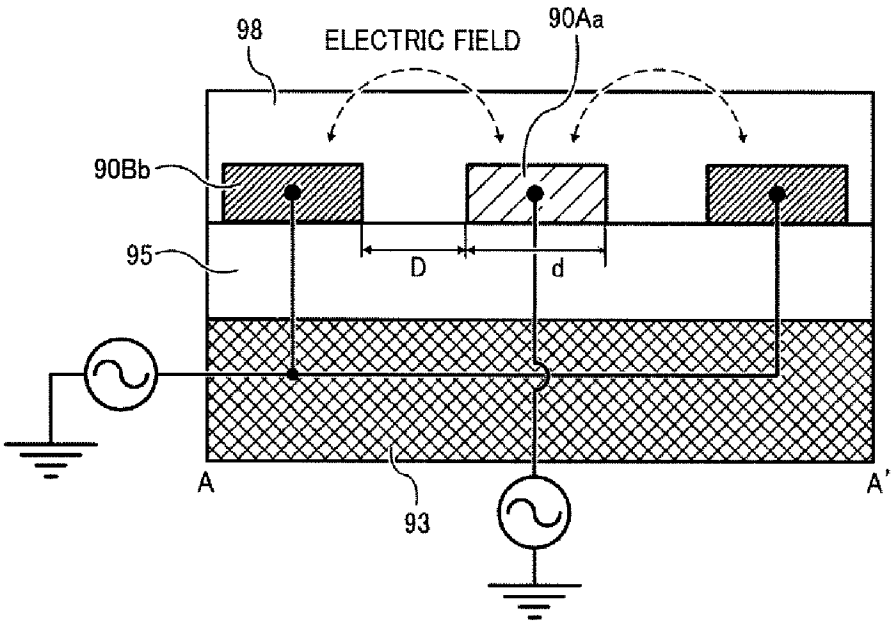

FIGS. 4A and 4B are cross-sectional and overhead views, respectively, illustrating an embodiment of a surface of the toner bearing member 9. FIG. 4A is a cross-section passing through a line A-A' in FIG. 4B. The toner bearing member 9 includes a first electrode pattern 90A comprising multiple linear electrodes 90Aa and a second electrode pattern 90B comprising multiple linear electrodes 90Bb. The electrodes 90Aa and 90Bb are alternately provided in the direction parallel to the axial direction of the toner bearing member 9. A surface layer 98 is provided on the electrode patterns 90A and 90B so as to cover and protect them.

A support 93 may be a cylindrical insulative support comprising a synthetic resin (e.g., polyimide, polycarbonate, nylon, fluorocarbon resin, polyacetal, phenol, polystyrene), or a synthetic-resin-covered cylindrical metallic conductive support obtained through cutting and polishing of a metal (e.g., aluminum, aluminum alloy, nickel, titanium, stainless steel).

A toner for use in the developing device and the image forming apparatus of the present specification can be obtained through typical pulverization or polymerization processes.

The toner preferably comprises a polyester resin, which quickly melts and has a relatively low viscosity when melting, to produce high-gloss image with high color reproducibility. Since such a toner is likely to cause high-temperature offset, it is preferable that a release agent such as silicone oil is applied to a fixing member. Alternatively, the toner includes a wax.

The toner preferably includes at least one of a carnauba wax, a rice wax, and an ester wax. A carnauba wax is a natural wax obtained from carnauba palm leaves. A rice wax is also a natural wax obtained by purifying a crude wax produced in a dewaxing or wintering process in purifying a rice bran oil. An ester wax is a synthetic wax obtained from an esterification reaction between a monofunctional straight-chain fatty acid and a monofunctional straight-chain alcohol.

These waxes can be used alone or in combination. The toner preferably includes the wax in an amount of from 0.5 to 20 parts by weight, and more preferably from 2 to 10 parts by weight.

Other than the waxes described above, polyolefin waxes such as polypropylene wax and polyethylene wax are also usable.

The above-described waxes can give a proper gloss to the resulting image. In a case where the toner includes no wax, the waxes can be applied onto the resulting image.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

An insulation layer coating liquid was prepared by dissolving 110 parts of an alkyd resin (BECKOLITE M6401-50 from DIC Corporation) and 60 parts of a melamine resin (SUPER BECKAMINE® G-821-60 from DIC Corporation) in 110 parts of methyl ethyl ketone.

A surface layer coating liquid was prepared by dissolving 10 parts of a polycarbonate (PANLITE® TS-2050 from Teijin Chemicals Ltd.) having the above-described unit (M-15) and a molecular weight of 50,000 and 0.002 parts of a silicone oil (KF-50 from Shin-Etsu Chemical Co., Ltd.) in a mixed solvent of 70 parts of tetrahydrofuran and 20 parts of cyclohexanone.

The insulation layer coating liquid was dip-coated on a cylindrical aluminum conductive support having a diameter of 30 mm and a length of 230 mm. The resulting support 91A had an insulation layer having a thickness of 20 μm.

A conductive thin copper film having a thickness of 0.8 μm was deposited on the insulation layer of the support 91A.

Further, a resist film having a thickness of 5 μm was formed on the thin copper film. The support 91A having the insulation layer covered with the thin cooper film and the resist film was then exposed to a laser beam to draw thereon a grid pattern having a width d of 100 μm, a length L of 200 mm, and an interval D of 200 μm. The grid pattern was developed in an aqueous solution of $Na_2CO_3$ and then etched in an aqueous solution of $FeCl_3$. Thus, electrodes 91Bb having an electrode pattern 91B were formed.

After masking one end of the electrode pattern 91B on the support 91A, a surface layer 98 having a maximum thickness of 10 μm was formed by dip-coating the surface layer coating liquid so as to cover the electrodes 91Bb. The toner bearing member 9 thus prepared was mounted on the developing device 4.

An alternating current bias having a frequency of 5 KHz and an average voltage of −200 V, having peaks at both −400 V and 0 V, was applied from an alternating current source to a terminal provided at an opening of the developing device 4 and the conductive support.

A black toner for an image forming apparatus IMAGIO NEO C320 (from Ricoh Co., Ltd.), including no wax, was mounted on the developing device 4, and the developing device 4 was mounted on the black station of the IMAGIO NEO C320 to produce images.

The degree of toner hopping was evaluated by blowing off toner particles, which were repeatedly hopping on the toner bearing member, by a blower. When no toner particle remained on the toner bearing member after the blowing, 100% of toner particles were regarded as being hopping. The degree of toner hopping is graded as follows.

Rank 1: 25% or less of toner particles were hopping.

Rank 2: 25% to 50% of toner particles were hopping.

Rank 3: 50% to 75% of toner particles were hopping.

Rank 4: 75% or more of toner particles were hopping.

Additionally, the produced image was visually observed whether background portions were contaminated with toner particles or not.

Example 2

The procedure in Example 1 is repeated except for replacing the polycarbonate (PANLITE® TS-2050 from Teijin Chemicals Ltd.) having the above-described unit (M-15) and a molecular weight of 50,000 with another polycarbonate (PANLITE® C-140 from Teijin Chemicals Ltd.) having the above-described unit (M-1) and a molecular weight of 37,500.

Example 3

The procedure in Example 1 is repeated except for replacing the toner for IMAGIO NEO 320 including no wax is replaced with the toner for another image forming apparatus IMAGIO MP C5000 including a wax, manufactured through an ester elongation polymerization.

Example 4

The procedure in Example 2 is repeated except for replacing the toner for IMAGIO NEO 320 including no wax is replaced with the toner for another image forming apparatus IMAGIO MP C5000 including a wax.

Comparative Example 1

The procedure in Example 1 is repeated except that the surface layer is formed with the insulation layer coating liquid.

Comparative Example 2

The procedure in Example 1 is repeated except that the surface layer is formed by spray-coating another surface layer coating liquid including a silicone resin (RSR213 from Dow Corning Toray Co., Ltd.).

Comparative Example 3

The procedure in Example 1 is repeated except for replacing the surface layer coating liquid with another surface layer coating liquid dissolving 89 parts of a polyester resin (VYLON® 20SS from Toyobo Co., Ltd.) and 143 parts of a melamine resin (CYMEL® 325 from Cytec Industries Inc.) in 238 parts of methyl ethyl ketone.

Comparative Example 4

The procedure in Comparative Example 1 is repeated except for replacing the toner for IMAGIO NEO 320 including no wax is replaced with the toner for another image forming apparatus IMAGIO MP C5000 including a wax.

Comparative Example 5

The procedure in Comparative Example 2 is repeated except for replacing the toner for IMAGIO NEO 320 including no wax is replaced with the toner for another image forming apparatus IMAGIO MP C5000 including a wax.

Comparative Example 6

The procedure in Comparative Example 3 is repeated except for replacing the toner for IMAGIO NEO 320 including no wax is replaced with the toner for another image forming apparatus IMAGIO MP C5000 including a wax.

Comparative Example 7

The procedure in Example 1 is repeated except that the insulation layer is formed with the surface layer coating liquid.

The evaluation results are shown in Table 1. Table 1 shows that normal toner hopping is caused in Examples 1 to 4 without producing abnormal image having background contamination. By contrast, toner hopping is insufficiently caused in Comparative Examples 1 to 6 with producing abnormal image having background contamination.

In Comparative Example 7, when the surface layer coating liquid is dip-coated on the insulation layer, the electrodes are released from the insulation layer into the surface layer coating layer liquid. Thus, the resulting toner bearing member has no electrode and no toner hopping is caused.

TABLE 1

| | Degree of toner hopping | Production of abnormal image |
|---|---|---|
| Example 1 | Rank 4 | No |
| Example 2 | Rank 4 | No |
| Example 3 | Rank 4 | No |

TABLE 1-continued

| | Degree of toner hopping | Production of abnormal image |
|---|---|---|
| Example 4 | Rank 4 | No |
| Comparative Example 1 | Rank 2 | Yes |
| Comparative Example 2 | Rank 2 | Yes |
| Comparative Example 3 | Rank 2 | Yes |
| Comparative Example 4 | Rank 1 | Yes |
| Comparative Example 5 | Rank 1 | Yes |
| Comparative Example 6 | Rank 1 | Yes |
| Comparative Example 7 | — | — |

Additional modifications and variations of the present invention are possible in light of the above teachings. It is therefore to be understood that within the scope of the appended claims the invention may be practiced other than as specifically described herein.

What is claimed is:

1. A toner bearing member, comprising:

a conductive support;

an insulation layer provided on the conductive support;

multiple electrodes arranged at regular intervals on the insulation layer;

a surface layer covering the multiple electrodes, comprising a polycarbonate having a unit represented by the following formula (1); and a voltage applicator that applies a voltage between the conductive support and the multiple electrodes while periodically reversing an electric field generated therebetween:

(1)

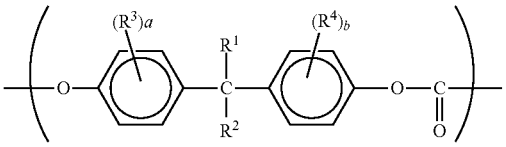

wherein each of $R^1$ and $R^2$ independently represents a hydrogen atom, an alkyl group, an aryl group, or $R^1$ and $R^2$ may share ring connectivity to form a cyclic hydrocarbon group having 5 to 8 carbon atoms; each of $R^3$ and $R^4$ independently represents a hydrogen atom, a halogen atom, an alkyl group, or an aryl group; and each of a and b independently represents an integer of 1 or 2.

2. A developing device comprising the toner hearing member according to claim 1.

3. An image forming apparatus, comprising:

an electrostatic latent image bearing member for bearing an electrostatic latent image; and the toner hearing member according to claim 1 for supplying toner particles to the electrostatic latent image.

4. The image forming apparatus according to claim 3, wherein the toner particles include a wax.

5. An image forming method, comprising:

applying an electrical field to a toner bearing member bearing toner particles, disposed in proximity to an image bearing member bearing an electrostatic latent image;

periodically reversing the electric field applied to the toner bearing member to cause the toner particles to move circumferentially along the rotating surface of the toner bearing member; and supplying the moving toner particles from the toner bearing member to the electrostatic latent image on the image bearing member;

wherein the toner bearing member comprises:

a conductive support;

an insulation layer provided on the conductive support;

multiple electrodes arranged at regular intervals on the insulation layer;

a surface layer covering the multiple electrodes, comprising a polycarbonate having a unit represented by the following formula (1); and a voltage applicator that applies a voltage between the conductive support and the multiple electrodes while periodically reversing the electric field generated therebetween:

(1)

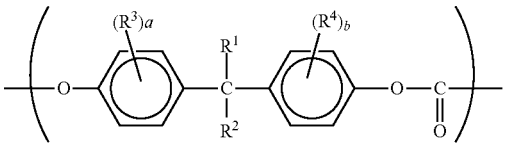

wherein each of $R^1$ and $R^2$ independently represents a hydrogen atom, an alkyl group, an aryl group, or $R^1$ and $R^2$ may share ring connectivity to form a cyclic hydrocarbon group having 5 to 8 carbon atoms; each of $R^3$ and $R^4$ independently represents a hydrogen atom, a halogen atom, an alkyl group, or an aryl group; and each of a and b independently represents an integer of 1 or 2.

6. The image forming method according to claim 5, wherein the toner particles include a wax.

* * * * *